US009439545B2

(12) United States Patent
Baek et al.

(10) Patent No.: US 9,439,545 B2
(45) Date of Patent: Sep. 13, 2016

(54) WINDOW CLEANING APPARATUS CAPABLE OF SUPPLYING POWER IN REAL-TIME FROM INNER UNIT TO OUTER UNIT

(71) Applicant: INDUSTRY-ACADEMIC COOPERATION FOUNDATION, YONSEI UNIVERSITY, Seoul (KR)

(72) Inventors: Yoon Su Baek, Seoul (KR); Jong Hyun Choi, Goyang-si (KR)

(73) Assignee: INDUSTRY-ACADEMIC COOPERATION FOUNDATION, YONSEI UNIVERSITY (KR)

( * ) Notice: Subject to any disclaimer, the term of this patent is extended or adjusted under 35 U.S.C. 154(b) by 160 days.

(21) Appl. No.: 14/357,017

(22) PCT Filed: Nov. 8, 2012

(86) PCT No.: PCT/KR2012/009403

§ 371 (c)(1),
(2) Date: Sep. 22, 2014

(87) PCT Pub. No.: WO2013/069987

PCT Pub. Date: May 16, 2013

(65) Prior Publication Data

US 2015/0026909 A1 Jan. 29, 2015

(30) Foreign Application Priority Data

Nov. 8, 2011 (KR) ..... 10-2011-0115704

(51) Int. Cl.

| | |
|---|---|
| ***A47L 1/03*** | (2006.01) |
| *A47L 1/13* | (2006.01) |
| *A47L 1/12* | (2006.01) |

(52) U.S. Cl.

CPC .. *A47L 1/03* (2013.01); *A47L 1/12* (2013.01); *A47L 1/13* (2013.01)

(58) Field of Classification Search

CPC ..... A47L 1/03; A47L 1/05; A47L 1/12; A47L 1/13; A47K 61/003; B60S 1/30

USPC ..... 15/103, 220.2

See application file for complete search history.

(56) References Cited

U.S. PATENT DOCUMENTS 3,983,591 A * 10/1976 Ohtaki ..... A47L 1/12 15/103

7,313,840 B2 * 1/2008 Watkins ..... F04D 13/027 15/103

FOREIGN PATENT DOCUMENTS

| | | |
|---|---|---|
| JP | 11332795 | 12/1999 |
| KR | 20200305524 | 2/2003 |

(Continued)

OTHER PUBLICATIONS

International Search Report—PCT/KR2012/009403 dated Feb. 21, 2013.

*Primary Examiner* — Laura C Guidotti

(74) *Attorney, Agent, or Firm* — Cantor Colburn LLP

(57) ABSTRACT

A window cleaning apparatus comprises: a first cleaning unit, which is positioned on one side of a window, having at least one built-in first magnetic module comprising a magnet; and a second cleaning unit, which is positioned on the opposite side of the window on which the first cleaning unit is positioned, having at least one built-in second magnetic module, which comprises a magnet having an opposite polarity to the magnetic module of the first cleaning unit so as to generate magnetic attraction with the first magnetic module. The second cleaning unit comprises an induction electricity generating module for generating electricity by inducing the change in the magnetic field emanating from the first magnetic module and/or the second magnetic module into voltage by means of electromagnetic induction.

13 Claims, 5 Drawing Sheets

(56) References Cited

FOREIGN PATENT DOCUMENTS

| | | |
|---|---|---|
| KR | 100550279 | 2/2006 |
| KR | 1020060085274 | 7/2006 |
| KR | 100780647 | 11/2007 |
| KR | 100987121 | 10/2010 |
| KR | 101003486 | 12/2010 |

* cited by examiner

WINDOW CLEANING APPARATUS CAPABLE OF SUPPLYING POWER IN REAL-TIME FROM INNER UNIT TO OUTER UNIT

TECHNICAL FIELD

The present invention relates to a magnetic attachment type window cleaning apparatus in which a pair of cleaning units each having a built-in magnet or the like, which are attached to both surfaces of a window by means of magnetic attraction, clean the outer surface or both surfaces of the window simultaneously while moving along the surface of the window.

More particularly, the present invention relates to an improved window cleaning apparatus in which an externally driven cleaning unit is supplied with the needed power from an internal cleaning unit in real-time and continuously so that the external cleaning unit can drive a sensor or a detergent supply pump even without having a separate power source such as a rechargeable battery built therein.

BACKGROUND ART

In general, if glass windows installed on wall surfaces of a building are allowed to stand for a long period of time, they are easily contaminated by being influenced by external dust, environmental pollution, rainwater, and the like, and thus become dirty. For this reason, the windows installed on the outer wall of the building are required to be frequently washed in a proper cycle in order to maintain a daylighting property and an aesthetic sense. However, in such a window washing work, the inner surface of the window where a person's hands reach can be cleaned relatively easily using rags or the like. On the other hand, since the outer surface of the window where a person's hands do not reach well is very inconvenient and difficult to clean, the dirty window is generally left to stand. In particular, in case of the veranda window of high-rise apartments, it is required that a person should wash the window while watching the outside view with him or her sticking his or her head out of the window in order to watch the outer surface of the window. Thus, conventionally, there occurs a problem in that the cleaning of the window is inconvenient and involves a considerable risk in terms of safety. In an attempt to solve the problem, there have been developed various window cleaning devices which can wash the window more conveniently and safely.

Among these window cleaning devices, the window cleaning devices which are currently used most conveniently are so-called magnet type double-sided window cleaning devices that allows a user to clean both surfaces of a glass window at the inner side of a building. Such a conventional double-sided glass window cleaning device has a slight difference in the detailed structure depending on each product, but is basically configured such that a pair of cleaning units having a built-in magnet are disposed on the indoor and outdoor side surfaces of the window so that a user moves the indoor side window cleaning unit along the surface of the window to wash the window with him or her griping it in a state in which the cleaning units are attached to each other, and thus the washing operation can be performed on the outdoor and indoor side surface of the glass window simultaneously.

The window cleaning device that is configured to simultaneously clean the indoor side surface or both surfaces of the window using the magnet has currently been developed in various forms. Such a magnet type glass window cleaning device can easily found in a plurality of documents including Korean Patent Registration No. 550279, Korean Patent Laid-Out Publication No. 10-2006-0085274, and Korean Utility Model Registration No. 0305524.

Such a conventional magnet type window cleaning device has an advantage in that a user can clean the outdoor side surface of a window even without going out but still entails problems in that since the user moves the cleaning device by applying a force to a body unit with him or her gripping a handle personally to clean the window, he or she suffers from an inconvenience in use, and in that if the user does not apply a force in parallel with the glass surface to move the cleaning device, the outdoor side cleaning unit frequently falls down from the window. In addition, the conventional magnet type window cleaning device has disadvantages in that since the cleaning device is moved along the surface of the window only once to clean the window, old dirt stuck to the window is difficult to clean clearly, and in that in the case where a window is positioned at a high position where a user does not reach, he or she suffers from an inconvenience of having to climb up to the window using a ladder or a chair to clean the window.

Accordingly, the present inventor has developed an automatic window cleaning robot that can perform a cleaning operation while automatically moving on the surface of the window in an attempt to improve the problems associated with the conventional magnet type window cleaning device. The automatic window cleaning robot has been registered as Korean Patent Registration Nos. 10-1003486 and 10-0987121. The window cleaning robot according to the previously registered invention includes indoor and outdoor side robot units employing a drive wheel having a built-in magnet or magnetic material and uses a magnetic attraction between the drive wheels as a normal force necessary for the friction drive so that the robot units automatically perform a cleaning operation while being moved in a state of coming into close contact with the surfaces of the window. According to the previously registered invention as described above, there is provided a mechanism that can be automatically moved by the drive wheel even on the surface of the window, which is perpendicular to the ground surface so that an inconvenience involved in the conventional cleaning device is resolved in which a user must move the cleaning device with him or her gripping it personally to clean the window, and thus a window cleaning operation can be performed effectively.

Meanwhile, according to the automatic window cleaning robot as described above, since the outdoor side robot unit performing a cleaning operation is moved together with the indoor side robot unit by being attracted by the indoor side robot unit, a large capacity power supply is not needed but the automatic window cleaning robot preferably includes a built-in power supply needed to additionally drive a detergent supply pump or a sensor.

As a power supply for the outdoor side robot unit, a rechargeable battery can be contemplated which is built in the outdoor side robot unit and is re-charged for use after being operated for a predetermined time period. However, according to the aforementioned method, a user must check a battery charge state of the outdoor side robot unit at any time to recharge the rechargeable battery periodically. In this case, it is required that the entire drive of the robot should be stopped and the indoor and outdoor side robot units be separated from the window to recharge the battery, and then should be disposed on the surface of the window. Thus, there occurs a problem in that the user suffers from an inconvenience in use. In addition, the outdoor side robot unit has a separate battery built therein, thereby leading to an increase in the total weight of the outdoor side robot unit, and thus adversely affecting driving performance and safety of the robot unit. Further, there are many disadvantages in that a battery as a consumable having a limited lifespan must be purchased additionally and is required to be maintained.

DISCLOSURE OF INVENTION

Technical Problem

Accordingly, the present invention has been made to solve the above-mentioned problems occurring in the prior art, and it is an object of the present invention to provide an improved window cleaning apparatus in which an external robot unit performing a cleaning operation on the outer surface of a window includes a simple power supply means to enable necessary devices such as a detergent supply pump or several sensors to be driven and allow the external robot unit to be supplied with needed power from an internal robot unit, but not an existing rechargeable battery or the like, so that the weight of the cleaning apparatus can be greatly reduced even without having a separate built-in power source such as the battery or the like and inconvenience of a user such as the removal and re-mounting of the cleaning apparatus according to the recharge of the battery can be avoided.

Technical Solution

To achieve the above object, in one aspect, the present invention provides a window cleaning apparatus in which a pair of cleaning units respectively attached to both surfaces of a window by means of a magnetic attraction clean one surface or both surfaces of the window simultaneously while moving along the surface of the window, the apparatus comprising: a first cleaning unit disposed on one side of a window and having at least one built-in first magnetic module comprising a magnet; and a second cleaning unit disposed on the other side of the window so as to be opposed to the first cleaning unit, and having at least one built-in second magnetic module comprising a magnet having an opposite polarity to that of the first magnetic module of the first cleaning unit so as to generate a magnetic attraction between the first magnetic module and the second magnetic module, wherein the second cleaning unit comprises an induction electricity generating module for generating an induced electromotive force to produce electricity by using a change in the magnetic field generated from the first magnetic module and/or the second magnetic module.

In addition, in the window cleaning apparatus, preferably, the first magnetic module may be configured such that a portion having an N-pole and a portion having an S-pole are divided into a plurality of regions, and the first magnetic module can be moved or rotated so that the strength or direction of an electric field measured at a given position can be changed over time.

In this case, preferably, the first magnetic module may be configured such that a portion having an N-pole and a portion having an S-pole are divided into a plurality of regions so that the second magnetic module is moved or rotated in cooperation with the first magnetic module during the rotation and movement of the first magnetic module, and the induction electricity generating module generates electricity using a change in the magnetic field generated from the second magnetic module.

Meanwhile, in the window cleaning apparatus of the present invention, more preferably, the first cleaning unit and the second cleaning unit may include a first wiper and a second wiper configured to clean the surface of the window, respectively, and the first magnetic module and the second magnetic module may be coupled to the first wiper and the second wiper, respectively. In this case, the first magnetic module and the second magnetic module may be configured such that the N-polarity region and the S-polarity region are alternately arranged with each other in the circumferential direction of the rotary central axis of the first wiper and the second wiper.

According to the above configuration, when the magnetic modules in which N-poles and the S-poles are alternately arranged with each other by the rotation of the wipers, there occurs a change in the magnetic field over time, which allows an alternating current to flow in the coil included in the external cleaning unit by the magnetic induction and allows the alternating current to be converted into a direct current so that the direct current can be used as power needed for the external cleaning unit. Thus, in this case, the magnetic module including the wiper always rotating to perform a cleaning operation can be used as a power supply means so that power can be supplied to the external cleaning unit even without including a separate device.

Advantageous Effects

According to the window cleaning apparatus having the configuration as described above have the following advantageous effects.

An external robot unit is supplied with needed power from an internal robot unit, but not an existing rechargeable battery or the like, so that the weight of the cleaning apparatus can be greatly reduced even without having a separate built-in power source such as the battery or the like and inconvenience of a user such as the removal and re-mounting of the apparatus according to the recharge of the battery can be avoided.

In particular, according to a preferred embodiment of the present invention, a magnetic module is coupled to a rotational wiper in the supply of power between the cleaning robot units so that a change in the magnetic field is converted into power by electromagnetic induction upon the rotation of the wiper. In this case, the wiper of the cleaning robot unit continues to be rotated to perform a cleaning operation. Thus, according to a preferred embodiment of the present invention, since the inventive window cleaning apparatus employ the construction of an existing cleaning robot as it is to supply power without having the rechargeable battery or an additional complicated configuration, thereby resulting in simplification of the design of the entire apparatus.

BRIEF DESCRIPTION OF THE DRAWINGS

The above and other objects, features and advantages of the present invention will be apparent from the following detailed description of the preferred embodiments of the invention in conjunction with the accompanying drawings, in which.

EXPLANATION ON REFERENCE NUMERALS OF MAIN ELEMENTS OF THE DRAWINGS

Figure 1:
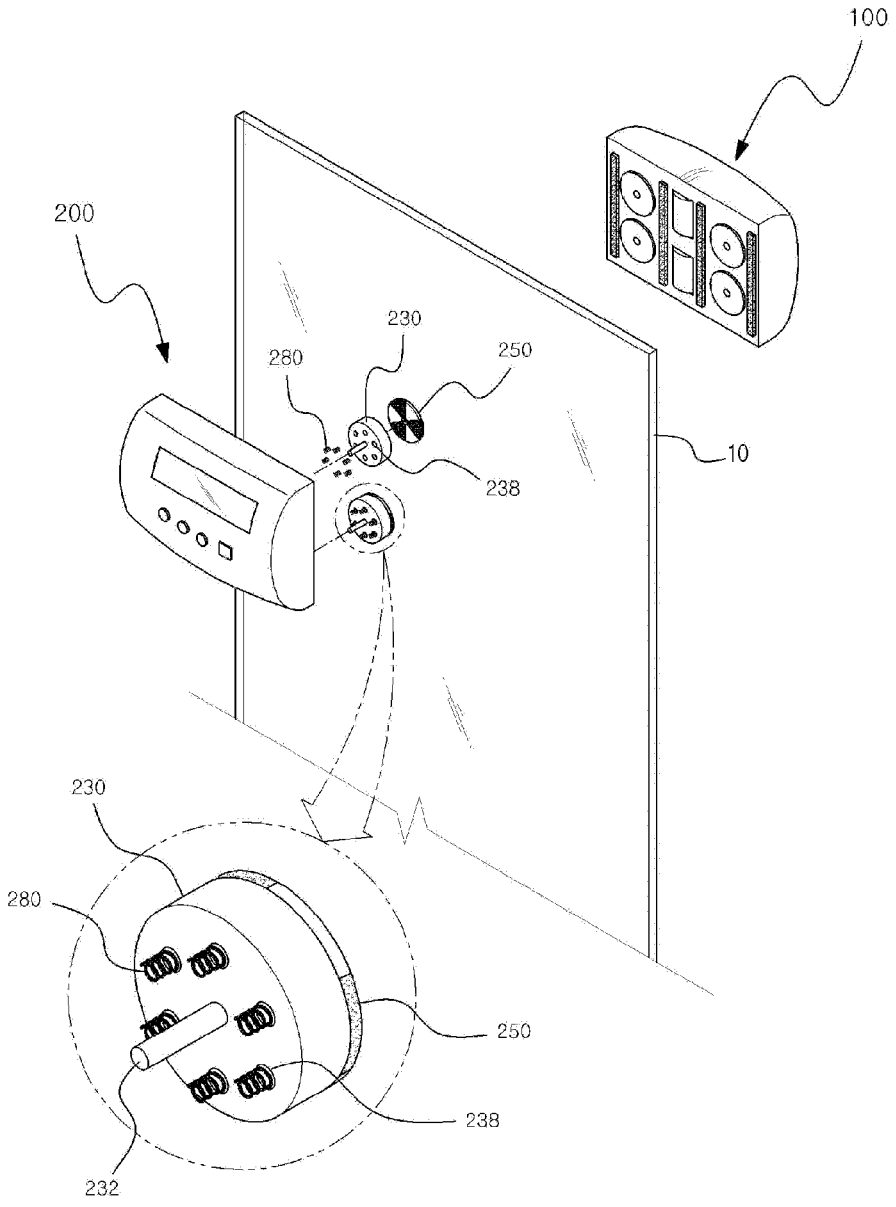
FIG. 1 is a schematic perspective view illustrating the entire use state of a window cleaning apparatus according to a preferred embodiment of the present invention.

100: first cleaning unit
110: main body frame
120: first drive wheel
125: wheel drive motor
130: first wiper
135: wiper drive motor
140: control module
150: first magnetic module
220: second drive wheel
230: second wiper
250: second magnetic module
280: induction electricity generating module

BEST MODE FOR CARRYING OUT THE INVENTION

Now, the configuration, operation and control method of a window cleaning apparatus according to the present invention will be described hereinafter in more detail with reference to the accompanying drawings.

Figure 2:
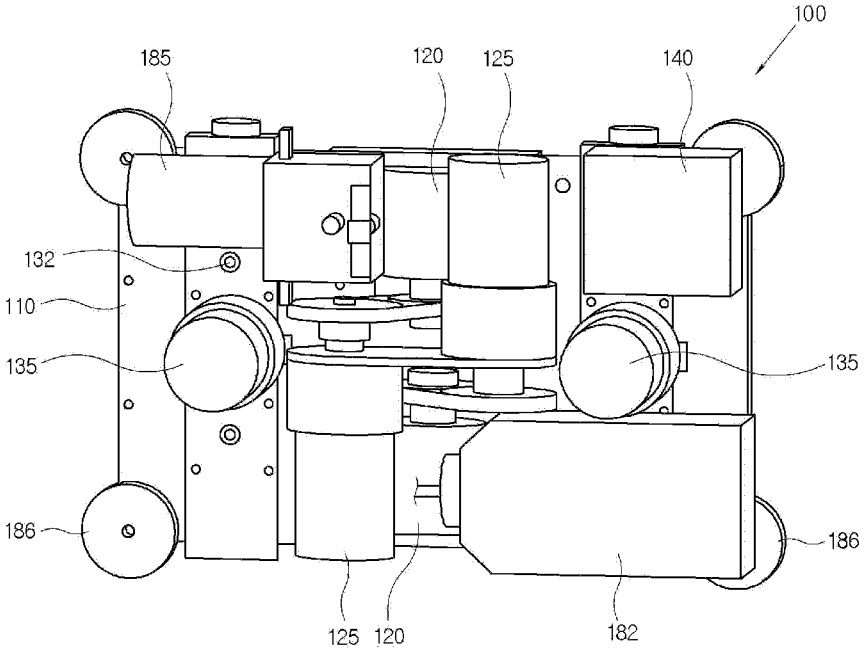
FIGS. 2 and 3 are views in detail illustrating a first cleaning unit of the window cleaning apparatus of the present invention shown in FIG. 1.
Figure 3:
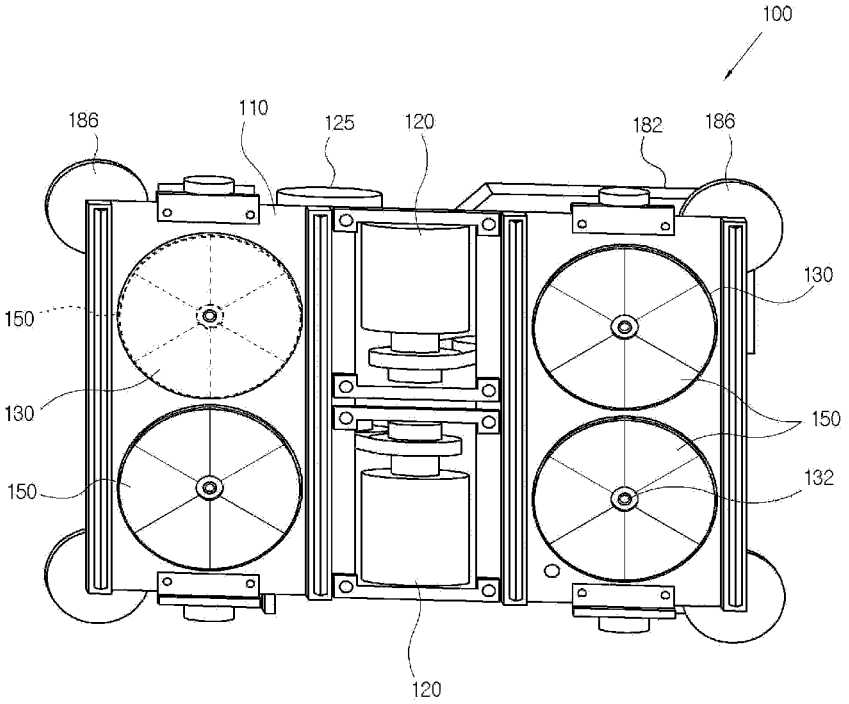
Figure 4:
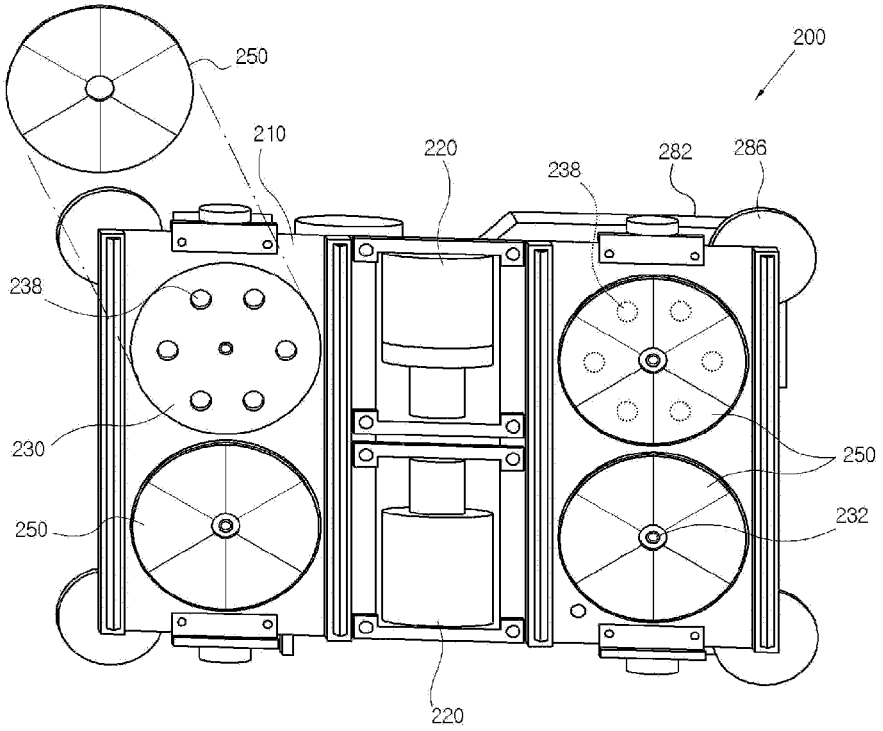
FIG. 4 is a view in detail illustrating a second cleaning unit of the window cleaning apparatus of the present invention shown in FIG. 1.

FIGS. 1 to 4 are views illustrating a window cleaning apparatus according to a preferred embodiment of the present invention, wherein FIG. 1 is a schematic perspective view illustrating the entire use state of a window cleaning apparatus according to a preferred embodiment of the present invention, FIGS. 2 and 3 are views in detail illustrating a first cleaning unit of the window cleaning apparatus of the present invention shown in FIG. 1, and FIG. 4 is a view in detail illustrating a second cleaning unit of the window cleaning apparatus of the present invention shown in FIG. 1.

As shown in FIG. 1, the window cleaning apparatus according to the present invention is a cleaning apparatus in which two independent cleaning units are attached to both sides of a window without any detachment and are moved together to wash the window using a magnetic force without any separate built-in support device. Referring to FIG. 1, it can be seen that the window cleaning apparatus according to the present invention consists of a set of two cleaning units such that it includes a first cleaning unit disposed on one side of a window and a second cleaning unit disposed on the other side of the window so as to be opposed to the first cleaning unit.

Referring to FIGS. 1 to 4, the first cleaning unit 100 is disposed on an indoor side surface of both surfaces of a glass window, and the second cleaning unit 200 is disposed on an outdoor side surface of the glass window. In addition, the first cleaning unit 100 and the second cleaning unit 200 include magnetic modules 150 and 250 for generating a magnetic force, respectively, so that they are attached to both surfaces of the glass window so as to confront each other by means of the magnetic attraction between the magnetic modules in use. Meanwhile, the first cleaning unit 100 may be disposed on the outdoor side surface of the glass window and the second cleaning unit 200 may be disposed on the indoor side surface of the glass window, if necessary.

Herein, the first cleaning unit 100 is a main unit that is disposed on the inner surface of the window installed on a wall of a building such as an apartment or the like. Referring to FIG. 2, the first cleaning unit 100 is configured such that it includes a wheel drive motor 125 therein so as to rotate a first drive wheel 120 so that it can be moved on the inner surface of the window by an external or internal power source. In case of most conventional magnetic attachment type cleaning apparatuses, when a user moves an indoor side cleaning unit of two cleaning units by applying a force to the cleaning unit while gripping it with his or her hands, an outdoor side cleaning unit is moved by means of the magnetic attraction between the indoor side cleaning unit and the outdoor cleaning unit. On the other hand, in case of the inventive window cleaning apparatus shown in the drawings, a drive wheel is brought into close contact with the inner surface of the window by means of the magnetic attraction of magnets to generate a frictional force necessary for movement of the cleaning unit, and thus the cleaning unit is automatically moved to perform a cleaning operation while maintaining a state of being attached to the surface of the window, thereby improving a convenience in use.

In addition, the second cleaning unit 200 is a cleaning unit that is disposed at a position of the window, which is opposed to the first cleaning unit 100, with the window interposed between the first cleaning unit 100 and the second cleaning unit 200. The second cleaning unit 200 is configured such that when the first cleaning unit 100 as the main unit is moved along the inner surface of the window 10 while maintaining a state of being attached to both surfaces of the window along with the first cleaning unit 100 by means of the magnetic attraction, the second cleaning unit 200 can be moved in cooperation with the first cleaning unit 100 by means of the magnetic attraction. In addition, according to the key technical features of the present invention as will be described in more detail later, the second cleaning unit 200 does not include a built-in power supply means, but is supplied with the needed power from the first cleaning unit 100 disposed at the opposite side of the window so that the total weight of the apparatus can be reduced.

In the meantime, the configuration of the first cleaning unit 100 of a preferred embodiment of the present invention will be described hereinafter in more detail with reference to FIGS. 2 and 3.

The first cleaning unit 100 may basically include a main body frame 110 that forms a body as a support structure, a first wiper 130 mounted on one side of the main body frame 110 so as to scrub and wash the surface of the window 10, a first drive wheel 120 as a wheel member that is moved in a rolling manner while coming into close contact with the surface of the window 10, and a first magnetic module 150 as a magnetic force generating means. In addition, the first cleaning unit 100 may further include a wiper drive motor 135 that rotates the first wiper 130, and a wheel drive motor 125 that provides a rotation drive force to the first drive wheel 120. A control module 140 may be provided to control various operations including the automatic movement of the window cleaning apparatus, the drive of the wiper, and the drive of the magnetic module which will be described later.

The first drive wheel 120 is mounted on the inner surface of the main body frame 110 so that the first cleaning unit 100 can be brought into close contact with the surface of the window 10 in a rolling manner to cause the first cleaning unit 100 to be moved along the surface of the window 10. In the present invention, the first drive wheel 120 may have a structure in which it includes a cylindrical permanent magnet built in a central portion thereof so that it can be coupled with the second drive wheel 220 by the magnetic attraction between the first drive wheel 120 and the second drive wheel 220. In addition, the first drive wheel 120 may have a structure in which it includes a frictional cover made of a rubber material formed at a periphery thereof so that when the first drive wheel 120 is moved on the surface of the window 10 while being brought into close contact with the surface of the window 10 in a rolling manner, sliding is prevented to transmit a smooth drive force. In the meantime, it is to be, of course, noted that the frictional cover encircling the outer peripheral surface of the first drive wheel 120 is not limited to the rubber material but may be made of various materials having a proper friction coefficient to prevent sliding.

The first wiper 130 serves to clean the surface of the window while coming into close contact with the surface of the window 10 when the first cleaning unit 100 is moved on the surface of the window 10. As shown in the drawings, the first wiper 130 is mounted on the inner surface of the first main body frame 110 so as to be rotated about a rotary shaft 132 so that it can be brought into close contact with the surface of the window 10 in a sliding manner while being rotated on the surface of the window 10. In a preferred embodiment of the present invention, the first wiper 130 is formed in the shape of a disk which is rotated about the rotary shaft 132 formed perpendicular to the surface of the window. Although the number of the first wiper 130 is four, the first wiper 130 may be implemented as the shape of a flat plate which scrubs the surface of the window through a linear reciprocating motion in addition to the shape of the disk. In addition, the first wiper 130 may be provided to have various shapes and numbers depending on the selection of a person of ordinary skill in the art. The first wiper 130 may further include a brush attached to the outer peripheral surface thereof so as to be brought into close contact with the surface of the window 10 so that the surface of the window 10 is cleaned effectively. Alternatively, the first wiper 130 may further include a fabric cover made of microfiber attached to the outer peripheral surface thereof.

Meanwhile, according to the present invention, the first cleaning unit 100 and the second cleaning unit 200 which will be described later include a first magnetic module 150 and a second magnetic module 250 as a means for generating a magnetic force, respectively, each of which has a built-in magnet or magnetic material. Preferably, the first magnetic module 150 and the second magnetic module 250 include a permanent magnet to serve to generate a magnetic force therebetween so that the first cleaning unit 100 and the second cleaning unit 200 are detachably attached to both surfaces of the glass window. Thus, the first and second cleaning units 100 and 200 respectively disposed on both surfaces of the glass window are attracted to each other and are brought into close contact with each other so that they can be moved simultaneously on the both surface of the window without any detachment.

The installation position of the first magnetic module 150 is not limited particularly, but is preferably is disposed inside first cleaning unit 100 so as to be positioned in proximity to the window so that the first magnetic module 150 can smoothly perform a magnetic coupling with the second magnetic module 250 of the second cleaning unit 200. As shown in FIGS. 1 to 4, according to the preferred embodiment of the present invention, the first magnetic module 150 is configured in the shape of a disk conforming to the shape of the first wiper 130 so that the first magnetic module 150 is fixedly coupled to the first wiper 130. The second magnetic module 250 is also coupled to the second wiper 230 provided in the second cleaning unit 200 correspondingly as shown in FIG. 4.

As such, according to the configuration in which the magnetic modules 150 and 250 are coupled to the first and second wipers 130 and 230, advantageously, the first wiper 130 and the second wiper 230 can be brought into close contact with both surfaces of the window with a proper force by means of the magnetic attraction between the magnetic modules, and thus contaminants adhered to the surfaces of the window can be removed cleanly, thereby ensuring a more efficient cleaning operation.

Figure 5:
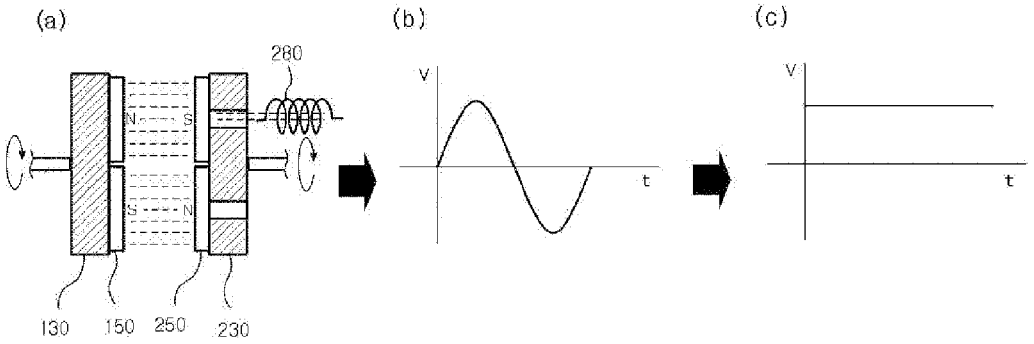
FIG. 5 is a view conceptually illustrating an action in which electricity is produced from an induction electricity generating module by means of the electromagnetic induction.

In addition, more preferably, the magnet included in the first magnetic module 130 is configured such that polarities of the predetermined polar regions divided radially are changed in the circumferential direction of the rotary shaft, i.e., an N-polarity region and an S-polarity region are alternately arranged with each other as shown in FIG. 5. By virtue of this configuration, in addition to the mutual attraction of the magnetic modules by the magnetic attraction between the magnetic modules, when the first wiper 130 is rotated, the second wiper 230 of the second cleaning unit 200 is operated in cooperation with the first wiper 130 so as to be rotated together with the first wiper 130. Thus, advantageously, the second cleaning unit 20 need not include a separate drive motor.

In the meantime, the first magnetic module 150 may be coupled to the first drive wheel 120 instead of the first wiper 130. Like this, it is advantageous that when the first magnetic module 150 is coupled to the first drive wheel 120, the drive wheels are brought into close contact with the surfaces of the window by means of the magnetic attraction between the first drive wheel 120 of the first cleaning unit 100 and the second drive wheel 220 and the second cleaning unit 200 to generate a frictional force so that the cleaning apparatus is driven more smoothly.

Figure 7:
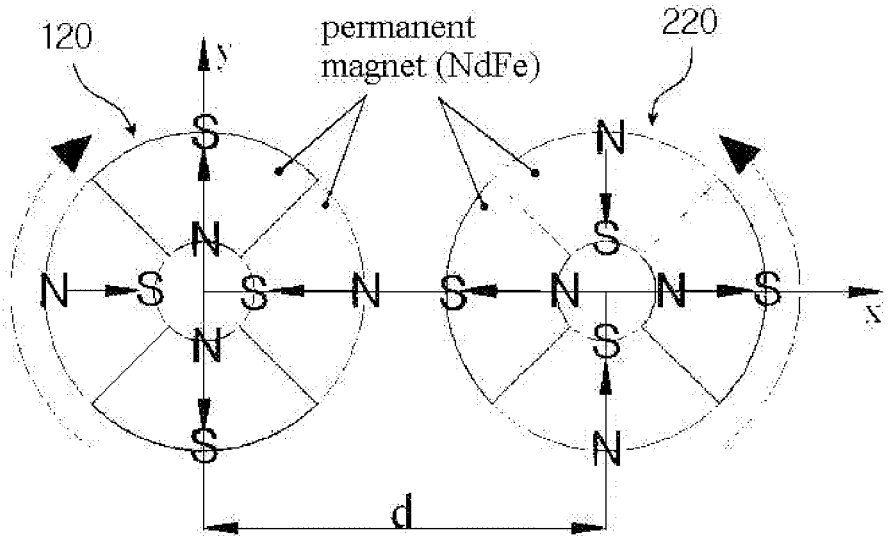
FIG. 7 is a view illustrating a magnet structure of a magnetic module and an operation of the magnetic module by the magnetic coupling when the magnetic module is coupled to a drive wheel in the window cleaning apparatus according to the present invention.

Further, as shown in FIG. 7, more preferably, the magnetic modules coupled to the first drive wheel 120 and the second drive wheel 220 are configured such that an N-pole and an S-pole are alternately arranged from each other along the outer peripheral surfaces of the first drive wheel 120 and the second drive wheel 220 so that the second drive wheel 220 can be rotated by receiving a rotation torque from the first drive wheel 120 by the magnetic coupling between the first magnetic module and the second magnetic module.

Next, the second cleaning unit 200 is a cleaning unit for cleaning the opposite surface of the window by constituting a pair with the first cleaning unit 100 while being moving on the opposite surface of the window. The second cleaning unit 200 is configured in the substantially same manner as the first cleaning unit 100. FIG. 4 is a view in detail illustrating a second cleaning unit of the window cleaning apparatus. Referring to FIG. 4, the second cleaning unit 200 includes a second main body frame 210, a plurality of second drive wheels 220, a plurality of second wipers 230, and a second magnetic module 250 for generating a magnetic force.

In the second cleaning unit 200, the second main body frame 210 forms a body of the second cleaning unit 200, and the second drive wheel 220, the second wiper 230 and the like are fixedly coupled to the second main body frame 210. The second cleaning unit 200 basically does not include the wheel drive motor unlike the first cleaning unit 100. The second cleaning unit 200 is mounted in a state of being axially fixed to the second main body frame 210 so that when it is rotated naturally during the movement of the second cleaning unit 200 together with the first cleaning unit 100, while being magnetically attracted by the first cleaning unit 100.

The second magnetic module 250 is preferably configured such that it is coupled to the second wiper 230 in the same manner as the first magnetic module 150. But, besides this configuration, the second magnetic module 250 may be configured such that it is coupled to the second drive wheel 220 to correspond to the installation position of the first magnetic module 150 or is mounted at other positions of the second cleaning unit 200.

In addition to the basic configuration as described above, various additional configurations may be included in the first cleaning unit 100 and the second cleaning unit 200. For example, the first cleaning unit 100 and/or the second cleaning unit 200 may further include washing solution tanks 182 and 282 so as to clean the window more effectively. For example, the first cleaning unit 100 and/or the second cleaning unit 200 may further include a washing solution tank (not shown) so as to clean the window more effectively. The washing solution tank is connected to a pump 185 (not shown in FIG. 4) through a hose, and sprays a proper amount of washing solution onto the surface of the window 10. In this case, preferably, the pump allows the washing solution to be sprayed around the wipers 130 and 230 so that the first wiper 130 and the second wiper 230 can clean the window effectively. In a more preferred embodiment of the present invention, elements constituting the rotary shafts 132 and 232 of the first wiper 130 and the second wiper 230 are formed as hollow tubular pipes, and the pump is configured such that the washing solution is sprayed onto the window 10 through the rotary shafts 132 and 232 of the wipers 130 and 230 so that the cleaning operation can be performed more effectively.

Moreover, in the embodiment as shown in FIGS. 2 and 4, each of the first and second main body frames 110 and 210 may further include at least one shock absorbing bumper 186 or 286 on the outer peripheral surface thereof. Each of the bumpers 186 and 286 serves to absorb a shock when the main body frames 110 and 210 collide against a window frame (not shown) provided at the edge of the window 10, thereby preventing the window frame or the cleaning unit from being damaged. Meanwhile, in the more preferred embodiment of the present invention, the bumpers 186 and 286 may include a contact sensor (not shown) for detecting the contact with an external object such as the window frame. For example, the contact sensor is implemented as a pressure sensor to detect a pressure generated upon the contact between the bumpers and the external object, but is not limited thereto. Also, it is to be, of course, noted that the contact sensor may be implemented as various known sensors such as photo sensors, which detect whether or not the bumpers 186 and 286 contact with or approaches an object.

According to the window cleaning apparatus of the present invention as constructed above, besides the first cleaning unit 100 including the wheel drive motor 125 and the wiper drive motor 135, the second cleaning unit 200 can also include the detergent supply pump or various kinds of sensors. The second cleaning unit 200 needs the supply of power to drive these devices. Thus, the second cleaning unit 200 may include a separate power supply module such as a rechargeable battery. In the case where the second cleaning unit 200 includes an existing power supply module, the total weight of the cleaning apparatus is increased, which adversely affects the driving performance and safety of the cleaning units. In addition, a user suffers from an inconvenience in use due to the periodical recharge of the battery and the re-mounting of the cleaning unit after recharge of the battery.

For this reason, in the present invention, the second cleaning unit 200 disposed on an outdoor side surface of the window includes a simple power supply means to enable necessary devices such as a detergent supply pump or several sensors to be driven and allow an electricity to be produced by the cooperative operation between the second cleaning unit and the first cleaning unit disposed on an indoor side surface of the window, but not an existing rechargeable battery or power supply that can be generally contemplated as the power supply means, so that the produced electricity can be used as power.

In other words, as described above, according to the window cleaning apparatus of the present invention, the first cleaning unit 100 and the second cleaning unit 200 includes the magnetic modules 150 and 250 built therein so as to perform maintenance of attachment and cooperative movement thereof on the surfaces of the window. The key technical features of the present invention reside in that an induced electromotive force is generated by the electromagnetic induction from a change in the magnetic field generated from the magnetic modules 150 and 250, and it can be used as power needed for the second cleaning unit 200.

Thus, according to the window cleaning apparatus of the present invention, an existing rechargeable battery or the like for the supply of power needed for the external second cleaning unit 200 to is not built in the cleaning apparatus so that the weight of the cleaning apparatus can be greatly reduced and inconvenience of a user such as the removal and re-mounting of the cleaning apparatus according to the recharge of the battery can be avoided.

In addition, as will be described below, according to a preferred embodiment of the present invention, in the supply of power using a change in the magnetic field of the magnetic module, the magnetic module is coupled to other elements which is always moving to perform a cleaning operation, such as the wiper rotatably washing the surface of the window or the drive wheel rotated to move the main body of the apparatus. According to this preferred configuration, the inventive cleaning apparatus additionally includes only a simple part such as an induction coil while employing an existing device as it is without including a separate configuration for the supply of power so that effective and continuous production of power is enabled, thereby making the design of the entire apparatus simple and reducing the manufacturing cost.

Hereinafter, the technical configuration, features and acting effects of the window cleaning apparatus enabling the real-time supply of power to the external cleaning unit from the internal cleaning unit will be described in further detail with reference to the accompanying drawings.

FIG. 5 shows simplification of the preferred configuration and operation of the induction electricity generating module 280 for generating an induced electromotive force using a change in the magnetic field generated from the second magnetic module 250 in the embodiments of the present invention shown in FIGS. 1 to 4.

Figure 6:
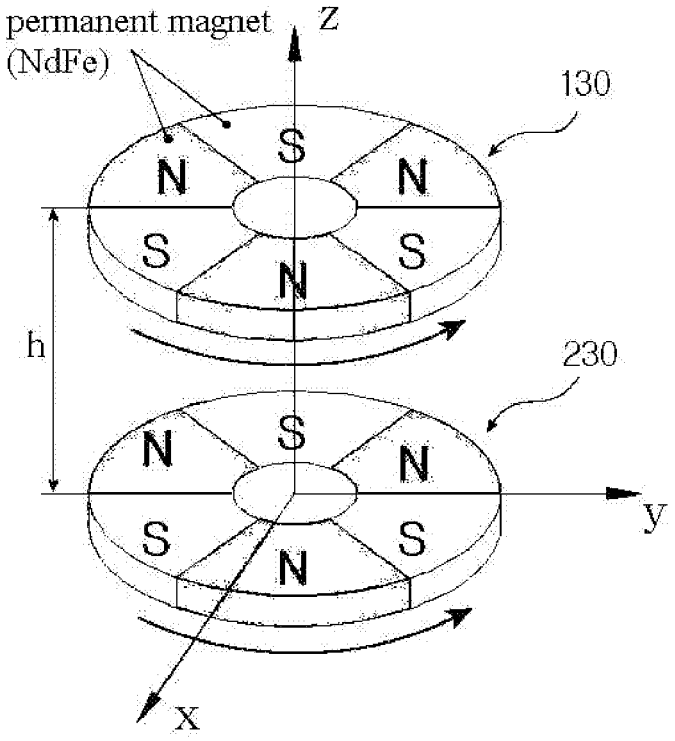
FIG. 6 is a view illustrating a magnet structure of a magnetic module and an operation of the magnetic module by the magnetic coupling when the magnetic module is coupled to a wiper in the window cleaning apparatus according to the present invention.

According to the configuration shown in FIG. 4, the second magnetic module 250 is mounted on the second wiper 250. At this time, the second magnetic module 250 is configured to have the shape of a disk at its entirety as shown in FIGS. 4 and 6 such that N-polarity regions and S-polarity regions divided radially are alternately arranged with each other in the circumferential direction of the rotary shaft. In addition, the induction electricity generating module 280 that generates power needed for the second cleaning unit 200 produces power by generating an induced electromotive force according to a change in the magnetic field of the second magnetic module 250. The induction electricity generating module 280 is fixedly mounted in the proximity to the second magnetic module 250 so as to be spaced apart from the second magnetic module 250. A proper capacity induction coil as the most simple and effective configuration can be preferably used as the induction electricity generating module 280.

Moreover, referring to FIGS. 2 and 3, the first magnetic module 150 of the first cleaning unit 100 is coupled to the first wiper 130 while conforming to the shape shown in FIG. 6 to correspond to the installation of the second magnetic module 250. Thus, when the wiper drive motor 135 is driven to rotate the first wiper 130 and the first magnetic module 150, the second wiper 230 and the second magnetic module 250 are rotated in cooperation with each other by means of the magnetic coupling between the first magnetic module 150 and the second magnetic module 250. In this case, the second magnetic module 250 in which the N-polarity regions and the S-polarity regions are alternately arranged with each other is rotated so that when viewed from a given position (i.e., a position where the induction coil is installed) within the second cleaning unit 200, the direction of the magnetic field is continuously changed reversely over time.

Thus, as the direction of the flux passing through the central portion of the induction coil 280 is continuously changed, an induced electromotive force is generated from the induction coil 280 by the electromagnetic induction so that an alternating current whose direction is constantly changed over time flows in the coil as shown in FIG. 5(*b*). The alternating current flowing in the induction coil 280 is converted into a direct current suitable for the drive of the apparatus within the second cleaning unit 200 through a rectifier circuit and a voltage smoothing capacitor using a bridge diode. In this case, the rectified DC power can be used for the drive of a device such as a sensor or the like, and may be stored in a separate charge capacitor or a small-sized rechargeable battery for use.

Meanwhile, according to the preferred configuration shown in FIG. 4, the second magnetic module 250 can be attached to the outer surface of the second wiper 130 so as to allow sufficient magnetic attraction to be generated between the second magnetic module 250 and the first magnetic module 150. In this case, in the coil type induction electricity generating module 280, the second wiper 230 is more preferably perforated at certain intervals to have through-holes 238 formed therein so as to allow a flux generated from the second magnetic module 250 to pass therethrough so that the induced electromotive force can be effectively generated.

According to the key technical features of the present invention as described above, the magnetic module indispensably included in the conventional magnet type window cleaning apparatus is not used as only an attachment maintaining means but is used as a power supply means for the external cleaning unit, so that the necessity for installation of an existing rechargeable battery for the supply of power needed for the external cleaning unit is eliminated, thereby preventing the weight of the apparatus from being increased, and thus reducing the manufacturing cost.

Further, the technical concept of the present invention may be implemented in various manners besides the embodiment shown in FIG. 5. For example, in the case where the N-poles and the S-poles are alternately arranged with each other in the second drive wheel 220 of the second cleaning unit 200 as shown in FIG. 7, the induction electricity generating module 280 may be configured such that the induction coil is fixed to the outer side of the lateral surface and the surface of an axial direction of the second drive wheel 220.

Figure 8:
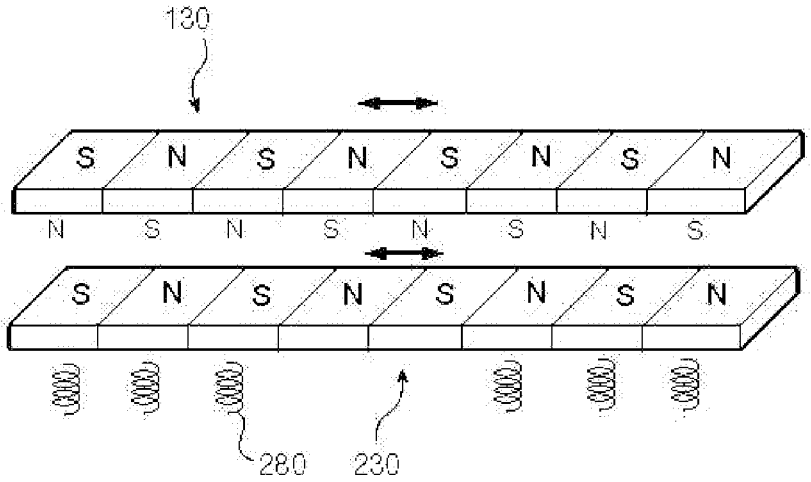
FIG. 8 is a view illustrating a state in which a magnetic module is coupled to a wiper in a window cleaning apparatus according to another preferred embodiment of the present invention.

In addition, as another example, the second wiper 230 may be configured in the shape of a band-like flat plate which is moved reciprocatingly in the direction parallel with the surface of the window as in an embodiment shown in FIG. 8 instead of the shape of the rotary disk as described above in term of the shape of the second wiper 230, and may be configured such that it has a built-in magnet in which N-polarity regions and S-polarity regions are alternately arranged to exhibit the same effect as that shown in FIG. 5 although the second magnetic module is configured.

Further, although not the best embodiment of the present invention, the configuration in which the induced electromotive force is generated from the induction electricity generating module 280 by using a change in the magnetic field from the first magnetic module 150 which passes through the window 10, but not a change in the magnetic field of the second magnetic module 250, can be construed to fall within the scope of the technical concept of the present invention. Furthermore, in the present invention, the number of the first magnetic module 150 and the second magnetic module 250 installed at the same position is preferably the same. But although the first magnetic module 150 is partially installed at a position where the first magnetic module 150 is not magnetically connected with the second magnetic module 250 in a state of being capable of being rotated or reciprocated and the induction coil is installed at the position of the second cleaning unit 200, which corresponds to the first magnetic module 150, power can be supplied to the cleaning unit using a change in the magnetic field generated from the magnetic module. Thus, this embodiment also falls within the technical scope of the present invention.

INDUSTRIAL APPLICABILITY

The technology related to the window cleaning apparatus according to the present invention can be applied to a window cleaning robot that has built-in magnetic modules so as to clean the window while moving with a magnetic force in a state of being attached to the surface of the window by means of the magnetic attraction between the magnetic modules.

While the present invention has been described in connection with the exemplary embodiments illustrated in the drawings, they are merely illustrative embodiments, and the invention is not limited to these embodiments. It is to be understood that various equivalent modifications and variations of the embodiments can be made by a person having an ordinary skill in the art without departing from the spirit and scope of the present invention. Therefore, the true technical scope of the present invention should be defined by the technical spirit of the appended claims.

The invention claimed is:

1. A window cleaning apparatus in which a pair of cleaning units respectively attached to both surfaces of a window by means of a magnetic attraction clean one surface or both surfaces of the window simultaneously while moving along the surface of the window, the apparatus comprising:

a first cleaning unit disposed on one side of a window and having at least one built-in first magnetic module comprising a magnet; and a second cleaning unit disposed on the other side of the window so as to be opposed to the first cleaning unit, and having at least one built-in second magnetic module comprising a magnet having an opposite polarity to that of the first magnetic module of the first cleaning unit so as to generate a magnetic attraction between the first magnetic module and the second magnetic module, wherein the second cleaning unit comprises an induction electricity generating module for generating an induced electromotive force to produce electricity by using a change in the magnetic field generated from the first magnetic module and/or the second magnetic module, and wherein the induction electricity generating module comprises an induction coil installed at a fixed position.

2. The window cleaning apparatus according to claim 1, wherein the first magnetic module is configured such that a portion having an N-pole and a portion having an S-pole are divided into a plurality of regions, and the first magnetic module can be moved or rotated so that the strength or direction of an electric field measured at a given position can be changed over time.

3. The window cleaning apparatus according to claim 2, wherein the first magnetic module is configured such that a portion having an N-pole and a portion having an S-pole are divided into a plurality of regions so that the second magnetic module is moved or rotated in cooperation with the first magnetic module during the rotation and movement of the first magnetic module, and the induction electricity generating module generates electricity using a change in the magnetic field generated from the second magnetic module.

4. The window cleaning apparatus according to claim 3, wherein the first cleaning unit and the second cleaning unit comprises a first wiper and a second wiper configured to clean the surface of the window, respectively, and the first magnetic module and the second magnetic module are coupled to the first wiper and the second wiper, respectively.

5. The window cleaning apparatus according to claim 4, wherein the first wiper and the second wiper are mounted to be rotatable about an axis perpendicular to the surface of the window, and the first magnetic module and the second magnetic module are configured such that the N-polarity region and the S-polarity region are alternately arranged with each other in the circumferential direction of the rotary central axis of the first wiper and the second wiper.

6. The window cleaning apparatus according to claim 5, wherein the first wiper and the second wiper are configured such that they are movable in parallel with the surface of the window, and the first magnetic module and the second magnetic module are configured such that the N-polarity region and the S-polarity region are alternately arranged with each other along the movement direction of the first wiper and the second wiper.

7. The window cleaning apparatus according to claim 5, wherein the second magnetic module is attached to the outer surface of the second wiper, and the second wiper has at least one through-hole formed thereon so that allow a magnetic flux generated from the second magnetic module to pass therethrough to cause an induced electromotive force to be generated from the induction electricity generating module.

8. The window cleaning apparatus according to claim 4, wherein the second magnetic module is attached to the outer surface of the second wiper, and the second wiper has at least one through-hole formed thereon so that allow a magnetic flux generated from the second magnetic module to pass therethrough to cause an induced electromotive force to be generated from the induction electricity generating module.

9. The window cleaning apparatus according to claim 1, wherein the first cleaning unit further comprises a first drive wheel configured to move the first cleaning unit while being rotated in a state of contacting with the surface of the window and a wheel drive motor configured to rotate the first drive wheel, and the first magnetic module is coupled to the first drive wheel and simultaneously the induction electricity generating module generates electricity using a change in the magnetic field generated from the first drive wheel.

10. The window cleaning apparatus according to claim 1, wherein the first cleaning unit further comprises a first drive wheel configured to move the first cleaning unit while being rotated in a state of contacting with the surface of the window and a wheel drive motor configured to rotate the first drive wheel, and the second cleaning unit comprises a second drive wheel configured to move the second cleaning unit while being rotated in a state of contacting with the surface of the window, and wherein the first magnetic module and the second magnetic module are coupled to the first drive wheel and the second drive wheel, respectively, so that the second drive wheel is rotated in cooperation with the first drive wheel by the magnetic coupling between the first magnetic module and the second magnetic module during the rotation of the first drive wheel and simultaneously the induction electricity generating module generates electricity using a change in the magnetic field generated from the second drive wheel.

11. The window cleaning apparatus according to claim 10, wherein the first magnetic module and the second magnetic module are configured such that an N-pole and an S-pole are alternately arranged from each other along the outer peripheral surfaces thereof.

12. The window cleaning apparatus according to claim 1, wherein the induction electricity generating module further comprises a rectifier circuit configured to convert an alternating current induced by the induction coil into a direct current.

13. The window cleaning apparatus according to claim 12, further comprising a charge module that can store a current generated from the induction electricity generating module.

* * * * *